US008083858B2

(12) United States Patent
Pulliainen

(10) Patent No.: US 8,083,858 B2
(45) Date of Patent: Dec. 27, 2011

(54) METHOD AND SYSTEM FOR CLEANING AN ARTILLERY GUN BARREL

(75) Inventor: Kalervo Pulliainen, Jyväskylä (FI)

(73) Assignee: Coefa Company Ltd Oy, Luvia (FI)

( * ) Notice: Subject to any disclaimer, the term of this patent is extended or adjusted under 35 U.S.C. 154(b) by 325 days.

(21) Appl. No.: 12/086,224

(22) PCT Filed: Jan. 19, 2007

(86) PCT No.: PCT/FI2007/050030

§ 371 (c)(1),
(2), (4) Date: Jun. 4, 2008

(87) PCT Pub. No.: WO2007/085693

PCT Pub. Date: Aug. 2, 2007

(65) Prior Publication Data

US 2009/0065028 A1 Mar. 12, 2009

(30) Foreign Application Priority Data

Jan. 25, 2006 (FI) ..... 20065051

(51) Int. Cl.
*C23G 1/00* (2006.01)

(52) U.S. Cl. ..... 134/2; 134/8

(58) Field of Classification Search ..... 134/2, 3, 134/6, 8, 22.1, 22.11, 40, 41, 42
See application file for complete search history.

(56) References Cited

U.S. PATENT DOCUMENTS 7,309,408 B2 * 12/2007 Benavides ..... 204/520
2004/0074523 A1 * 4/2004 Paananen et al. ..... 134/22.12

FOREIGN PATENT DOCUMENTS

| | | | |
|---|---|---|---|
| EP | 0846742 | | 6/1998 |
| JP | 2005105411 A | * | 4/2005 |
| WO | 0244642 | | 6/2002 |
| WO | 03072672 | | 9/2003 |

OTHER PUBLICATIONS

Machine Translation: JP 2005-105411A to Saito et al. Apr. 2005.*

* cited by examiner

*Primary Examiner* — Michael Kornakov
*Assistant Examiner* — Eric Golightly
(74) *Attorney, Agent, or Firm* — Fildes & Outland, P.C.

(57) ABSTRACT

The invention relates to a method for cleaning an artillery gun barrel, which is cleaned of gun oil, greases, or combustion residues using a washing liquid and a brush element. The brush element is moved backwards and forwards in the barrel with the aid of the washing liquid. In addition, copper is cleaned out of the simultaneously in the same process. The invention also relates to a system for cleaning an artillery gun barrel.

14 Claims, 1 Drawing Sheet

METHOD AND SYSTEM FOR CLEANING AN ARTILLERY GUN BARREL

Figure 1:
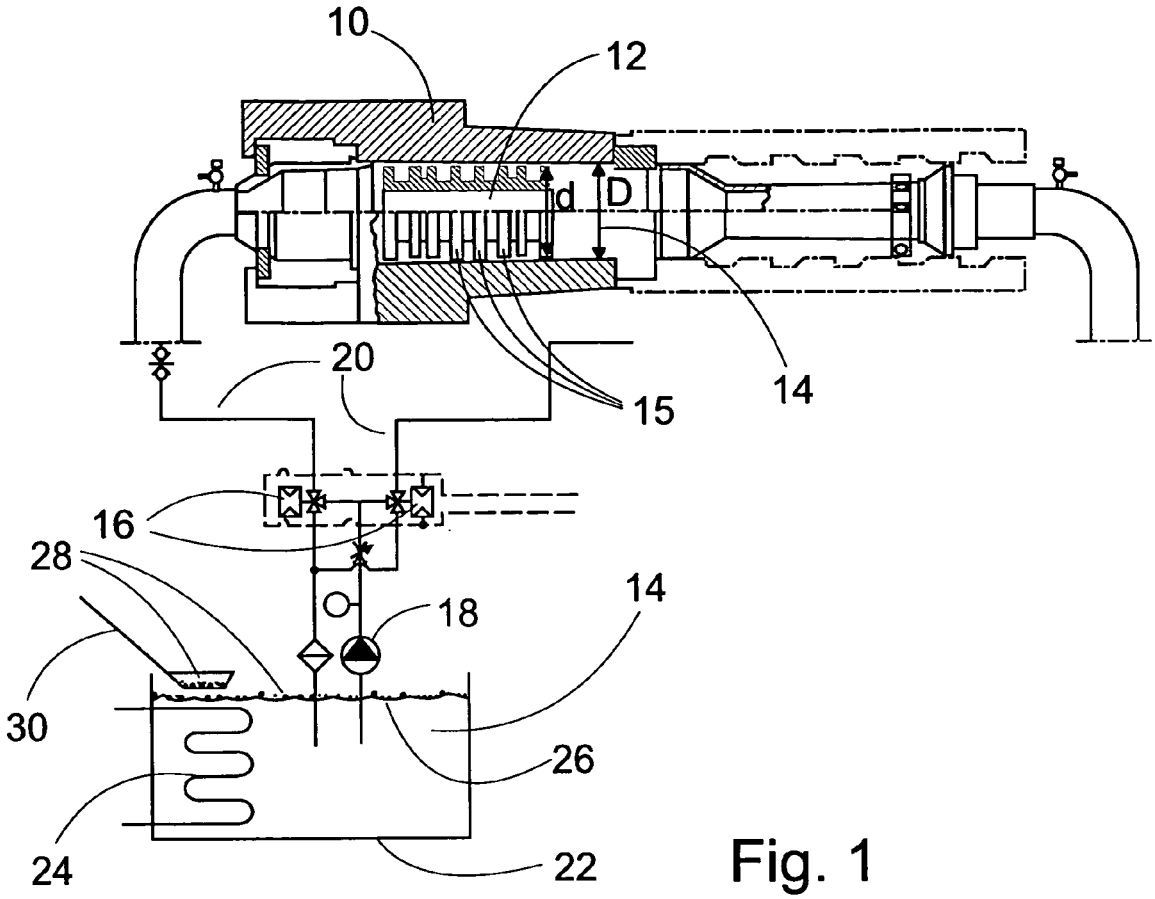

The present invention relates to a method for cleaning an artillery gun barrel, which artillery gun barrel is cleaned of gun oil, grease, or combustion residues using a washing fluid and a brush element, the brush element being moved backwards and forwards with the aid of the washing fluid. The invention also relates to a corresponding system.

Copper detaching from shells adheres to the interior of an artillery gun barrel. On the interior surface of the barrel there is also gun oil, grease, and combustion residues. The copper is dissolved with the aid of ammonia. Prior to dissolving with ammonia, however, the gun oil, grease, and combustion residues, which prevent the ammonia from reacting with the copper, must be washed out of the barrel. Dissolving with ammonia, is therefore preceded by a washing stage, to remove the gun oil, grease, and combustion residues.

The prior art washes artillery gun barrels in two stages. In the first stage, gun oil, grease, and combustion residues are washed out. In the second stage, the copper is dissolved off. In the first stage, the method according to patent FI95507 can be used. The dissolving of the copper, which takes place in the second stage, takes place using ammonia, which is put into the plugged artillery gun barrel. Dissolving with ammonia is very slow and it may take several days to clean a single artillery gun barrel. The long cleaning time in turn makes the process inefficient. In addition, the use of ammonia in cleaning creates environmental and especially work-safety problems.

In addition to ammonia, other substances suitable for cleaning an artillery gun barrel are also known. These substances share the common property that they should be used on a clean copper surface. If there is, for example, gun oil, grease, or combustion residues on the copper surface, dissolving copper from the surface will fail, or will be considerably slower than from a cleaned surface.

The invention is intended to create a method and system, the use of which will facilitate the cleaning of an artillery gun barrel, achieve an improved cleaning result, and be more certain than before. Cleaning can also be performed more rapidly. In addition, greater work safety will also be achieved. The characteristic features of the method according to the invention are stated in the accompanying Claim 1 while the characteristic features of the system are stated in Claim 11. In the method and system according to the invention, gun oil, grease, and combustion residues, as well as copper, are removed by a single washing, in which a brush element and a washing fluid are used.

In the cleaning of the artillery gun barrel of gun oil, grease, and combustion residues a washing fluid and a brush element are used. The brush element is moved backwards and forwards in the barrel with the aid of the washing fluid. In addition, the artillery gun barrel is simultaneously cleaned of copper in same process. Cleaning an artillery gun barrel is simpler than before, as gun oil, grease, and combustion residues, as well as copper, are removed in a single washing. The copper is also detached more rapidly from the artillery gun barrel than when using dissolving without a brush element, as the brush element also removes the oxide layer that accumulates on the copper surface. The removal of the oxide layer accumulated on the surface of the copper layer accelerates the dissolving of the copper. In addition, the washing fluid can be used to wash several guns, if the residuum collecting on the surface of the washing fluid and the copper dissolved in the washing fluid are removed.

In one embodiment, the brush element moves backwards and forwards at intervals of 0.25-10 minutes, preferably 0.5-2 minutes. Gun oil, grease, combustion residues, and copper oxide are then washed out of the artillery gun barrel. Once the gun oil, grease, combustion residues, and copper oxide have been removed, the copper in the artillery gun barrel is revealed. The revealed copper is brought into contact with the washing fluid, when a new layer of copper oxide is formed, to be removed by the brush element. Brushing that takes place at intervals of 0.25-10 minutes, preferably 0.5-2 minutes is effective, as the brushing will then remove the copper-oxide layer that has formed on the surface of the copper. If the time is less than 2 minutes, copper oxide, which can be removed, will be formed effectively the whole time. For its part, the washing fluid helps to form a copper-oxide layer, which is removed by the brush element. Removing the copper-oxide layer with the brush element accelerates the reaction between the washing fluid and the copper.

In a second embodiment, the washing fluid for cleaning gun oil, grease, or combustion residues from an artillery gun barrel, contains ammonium oxalate and an oxidizing agent. Together with the brush element, the washing fluid containing ammonium oxalate and an oxidizing agent effectively cleans the gun oil, grease, and combustion residues, and removes the copper. The brush element is centrally important to the cleaning result. As the washing fluid contains ammonium oxalate and an oxidizing agent, it can be used to remove fat-solvent substances, such as gun oil, grease, and combustion residues. A washing fluid containing ammonium oxalate and an oxidizing agent will remove not only fat-solvent substances, but also copper. In addition, it is good to use a washing fluid containing ammonium oxalate, as it has very little effect on the environment, compared to ammonia. In addition, washing fluid containing ammonium oxalate does not irritate the skin. As the washing fluid is not detrimental to the environment and does not irritate the skin, it is much easier to use than ammonia, for example. In addition, the washing solution can be manufactured economically, as ammonium oxalate is cheap. After washing, the amount of copper dissolved can be analysed from the washing fluid. In addition, the washing fluid is easy to manufacture.

In a third embodiment, the washing fluid contains 1-4 weight-%, preferably 1.5-3 weight-% of ammonium oxalate, as well as an oxidizing agent. Using the amounts in question, the washing fluid will be most effective in dissolving copper and fat-solvent substances.

In a fourth embodiment, the oxidizing agent is a hydrogen peroxide solution, of which there is 0.25-1.5 weight-%, preferably 0.5-1 weight-% in the washing fluid. The use of hydrogen peroxide as the oxidizing agent is supported by the fact that it causes no significant danger to the environment. As the washing fluid is neutralized by the oxidizing agent, it can be released as such into a normal sewer network.

In a fifth embodiment, the washing fluid is recycled and used to clean several guns. It is then preferable for the washing fluid to contain a buffering solution. With the aid of the buffering solution, the pH value of the washing fluid can be maintained at the desired level for a longer time. It is advantageous for the buffering solution to contain a weak acid and a strong alkali, so that the pH value of the washing fluid can be adjusted as desired to be slightly acid. By keeping the pH value at the desired level, particularly more gun oil, grease, and combustion residues can be cleaned using the same solution. Their cleaning in turn ensures the detaching of the copper.

In a sixth embodiment, the weak acid used in the buffering solution is citric acid, of which the washing fluid contains 1-4 weight-%, preferably 1.5-3 weight-%.

In a seventh embodiment, the strong alkali used in the buffering solution is sodium hydroxide (lye), of which the washing fluid contains 0.5-2 weight-%, preferably 0.75-1.5 weight-%.

In an eighth embodiment, the washing fluid is recycled through a tank, in which the washing fluid has a free surface. In addition, the residuum that collects on the said surface is removed. The removal of the residuum permits the washing fluid to be used for a longer time, and to be revived with a small chemical addition, to remove gun oil, grease, and combustion residues.

In a ninth embodiment, the washing fluid is cleaned of copper electrolytically, i.e. the copper dissolved in it is removed from the washing fluid. The cleaning of the washing fluid permits the washing fluid to be recycled, or to be released into a normal sewer network. The recycling of the washing fluid electrolytically thus increases the ability of the washing fluid to dissolve copper. In addition, the copper is recovered through the electrolysis.

Figure 2:
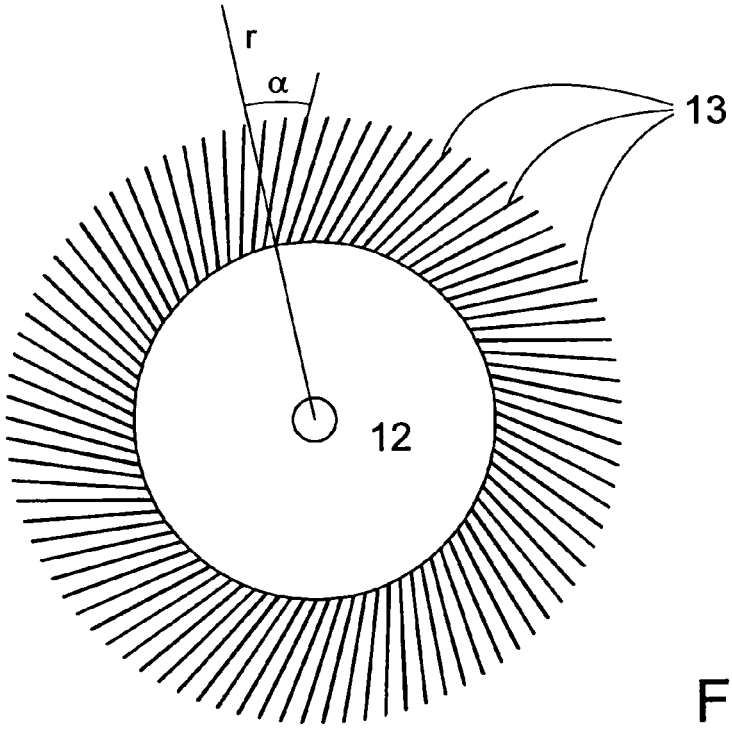

In the following, the invention is examined with the aid of examples and with reference to the accompanying drawings, in which FIG. 1 shows one washing apparatus for cleaning an artillery gun barrel, and FIG. 2 shows one brush element for using in the washing apparatus.

FIG. 1 shows a system according to the invention for cleaning the barrel of an artillery gun. The system includes a brush element 12, which is arranged to move backwards and forwards, in the artillery gun barrel 10. The movement of the brush element 12 in the artillery gun barrel 10 is arranged to take place with the aid of a washing fluid 14 intended to clean gun oil, grease, and combustion residues. In addition, the same system is arranged to simultaneously remove copper from the artillery gun barrel 10. By removing the copper simultaneously with the removal of gun oil, grease, and combustion residues, the cleaning of the artillery gun barrel is accelerated considerably.

In the system according to the invention, shown in FIG. 1, the external diameter d of the brush element 12 is 0-10%, preferably 0.5-5% greater than the internal diameter D of the artillery gun barrel 10. As the external diameter of the brush element is slightly greater than the internal diameter of the artillery gun barrel, the contact between the artillery gun barrel and the brush element will be sufficiently strong to remove gun oil, grease, and combustion residues, as well as copper that appears as copper oxide. On the other hand, the external diameter d of the brush element 12 can only be 10% greater than the internal diameter D of the artillery gun barrel 10, as otherwise the brush element would jam in the artillery gun barrel. The external diameter of the brush element is preferably only 5% greater than the smallest internal diameter of the artillery gun barrel, so that it will be possible to use very stiff bristles. The use of stiff bristles will effectively remove copper oxide.

In the system according to the invention, shown in FIG. 1, the brush element 12 is arranged to move backwards and forwards in the artillery gun barrel 10 at intervals of 0.25-10 minutes, preferably 0.5-2 minutes. By moving the brush level at intervals of less than 10 minutes, the copper oxide forming on the surface of the copper is removed so often that the copper on the internal surface of the artillery gun barrel is able to react with the washing fluid, without the copper-oxide layer preventing this.

FIG. 2 shows the brush element 12 used in the system according to the invention. The brush element 12 in question includes bristles 13. The angle $\alpha$ between the radius r of the brush element 12 and the bristles 13 is 2-70°, preferably 5-35°. At such an angle, the brush element will rotate as it moves in the artillery gun barrel. As the brush element rotates as it moves in the artillery gun barrel, it cleans the artillery gun barrel more effectively than a non-rotating brush element. The rotation promotes particularly the cleaning of the rifling.

The brush element 12 used in the system according to the invention, shown in FIG. 2, includes several brush bands 15 (FIG. 1). FIG. 1 shows two brush bands, in which in some of the brush bands 15 the bristles 13 face in the opposite direction. Thus, in some of the brush bands 15 (FIG. 1), the angle $\alpha$ between the radius r of the brush element 12 and the bristles 13 is positive and in some it is negative. As the bristles face in different directions to each other, the direction of rotation of the brush elements will change from time to time. The brush elements at different directions and the changing direction of rotation help to make the cleaning of the even more effective. Particularly the rifling will be well cleaned if the direction of rotation of the brush element changes from time to time.

In the washing apparatus shown in FIG. 1, the brush element 12 is moved backwards and forwards inside the artillery gun barrel 10 with the aid of the washing fluid 14. The valve group 16 is used to provide a two-way feed from the pump 18 to the connection lines 20. In the tank 22 there is an electrical resistance 24, by means of which the washing fluid 14 can be heated. The tank 22 can be open as in FIG. 1, or closed (not shown). The residuum 28 that collects on the surface of the washing fluid 26 can be lifted off with a scoop 30. If the tank is closed, the scum should be collected in some other way. Even in an open tank other methods, such as a scraper that moves on the surface, can be used. When the precipitates are collected the washing fluid can be circulated. If necessary, chemicals can be added to the washing fluid, in order to clean out gun oil, grease, and combustion residues. In that case, a washing fluid with the composition given at the end the present application can be used to wash guns, in such a way that about 7 g/l of copper oxide accumulates in the washing fluid. When the amount of copper oxide dissolved in the washing fluid approaches the saturation point, the ability of the washing fluid to dissolve copper oxide diminishes.

If the buffering solution keeps the pH value at the desired level the washing fluid can be used to wash several guns, as the ability of the washing fluid to dissolve gun oil, grease, and combustion residues will be retained. The washing fluid is circulated through a tank. When using the same washing fluid to wash several guns, residuum, which can be removed, will accumulate on the exposed surface of the recycling tank.

The washing fluid used in the method can be advantageously manufactured in 200-liter batches, which will be sufficient for washing about 20-30 artillery gun barrels. The actual washing fluid can be manufactured either directly at its use strength, or as a dilutable concentrate. Diluting from a concentrate is advantageous, because a smaller amount of the solution, which can be diluted to the desired strength at the washing location, will need to be delivered to the washing location.

One highly advantageous composition for the concentrate and washing fluid is created by manufacturing the concentrate and washing fluid as follows. Manufacture is best commenced by dissolving granules of NaOH in water. 1.8 kg of NaOH granules are dissolved in 7.5 liters of water. The NaOH granules are dissolved in cold water in batches of a maximum of half a kilogram, due to the exothermic reaction between them and the water.

The manufacture of the concentrate is commenced by dissolving 4,381 kilograms of ammonium oxalate in 40 liters of water, which has a temperature of 50-60° C. As dissolving proceeds while mixing continuously, the time required for it is about 15 minutes. After this, 5,144 kilograms of citric acid is dissolved into the solution. The dissolving of the citric acid takes about 5 minutes. Once the citric acid has dissolved, a previously prepared solution of sodium hydroxide, of which there is about 7.6 liters, is added. The dissolving of the sodium hydroxide solution takes about 5 minutes. After this, the pH value of the solution obtained is checked, and should be 4.5-4.7. After checking the pH value, 2.88 liters of hydrogen peroxide, with a strength of 50 weight-%, are added. Apart from the hydrogen peroxide, the substances to be added are all solids. The amount of hydrogen peroxide added depends on its strength. When referring to the percentage share of hydrogen peroxide in the washing solution, 100% refers to the share of hydrogen peroxide in the washing fluid. The washing fluid is made by diluting the concentrate obtained to 200 liters of washing fluid. Thus, about 150 liters of water are added to the concentrate.

The said concentrate consists of about 50 liters.

The concentrate contains:

| | |
|---|---|
| ammonium oxalate | 8 weight-%, |
| generally | 4-16 weight-%, |
| preferably | 6-12 weight-%, |
| hydrogen peroxide | 2.5 weight-% |
| generally | 1-6 weight-%, |
| preferably | 2-4 weight-%, |
| citric acid | 9 weight-% |
| generally | 4-16 weight-%, |
| preferably | 6-12 weight-%, and |
| sodium hydroxide | 4 weight-% |
| generally | 2-8 weight-%, |
| preferably | 3-6 weight-%. |

The invention claimed is:

1. Method for cleaning an artillery gun barrel, wherein the artillery gun barrel is cleaned of gun oil, greases, or combustion residues using a washing liquid and a brush element, comprising moving the brush element backwards and forwards with the aid of the washing liquid while circulating the washing liquid through the artillery gun barrel, the washing liquid containing ammonium oxalate and an oxidizing agent, cleaning out copper of the artillery gun barrel simultaneously with gun oil, greases, or combustion residues, the brush element having bristles and an external diameter of the brush element defined by the bristles is not more than 5% greater than an internal diameter of the artillery gun barrel, revealing a copper surface in the artillery gun barrel, from underneath a copper oxide layer, while removing a copper oxide layer that accumulates on the copper surface with the brush element, and bringing the revealed copper surface into contact with the washing liquid which dissolves the copper in the washing liquid.

2. Method according to claim 1, further comprising moving the brush element backwards and forwards in the artillery gun barrel at intervals of 0.25-10 minutes.

3. Method according to claim 1, characterized in that the washing liquid for cleaning the artillery gun barrel of gun oil, grease, combustion residues, and copper contains 1-4 weight % of ammonium oxalate.

4. Method according to claim 1, characterized in that hydrogen peroxide, of which there is 0.25-1.5 weight % in the washing liquid, acts as the oxidizing agent.

5. Method according to claim 1, characterized in that the washing liquid contains a weak acid and a strong alkali as a buffering solution.

6. Method according to claim 5, characterized in that the weak acid of the buffering solution is citric acid, of which the washing liquid contains 1-4 weight %.

7. Method according to claim 5, characterized in that the strong alkali of the buffering solution is sodium hydroxide, of which the washing liquid contains 0.5-2 weight %.

8. Method according to claim 1, further comprising circulating the washing liquid through a tank, and wherein the washing liquid has a surface, characterized in that during washing residuum accumulating on the said surface is removed.

9. Method according to claim 1, comprising cleaning the washing liquid electrolytically during recycling.

10. Method according to claim 1, further comprising moving the brush element backwards and forwards in the artillery gun barrel at intervals of 0.5-2 minutes.

11. Method according to claim 1, characterized in that the washing liquid for cleaning the artillery gun barrel of gun oil, grease, combustion residues, and copper contains 1.5-3 weight % of ammonium oxalate.

12. Method according to claim 1, characterized in that hydrogen peroxide, of which there is 0.5-1 weight % in the washing liquid, acts as the oxidizing agent.

13. Method according to claim 5, characterized in that the weak acid of the buffering solution is citric acid, of which the washing liquid contains 1.5-3 weight %.

14. Method according to claim 5, characterized in that the strong alkali of the buffering solution is sodium hydroxide, of which the washing liquid contains 0.75-1.5 weight %.

* * * * *